United States Patent [19]

Maruyama

[11] Patent Number: 5,040,967

[45] Date of Patent: Aug. 20, 1991

[54] MEANS FOR VERTICALLY MOVING A RAM IN A COMPRESSION MOLDING MACHINE

[75] Inventor: Tsuyoshi Maruyama, Shizouka, Japan

[73] Assignee: Fugaku Koki Co., Ltd., Tokyo, Japan

[21] Appl. No.: 546,258

[22] Filed: Jun. 29, 1990

[30] Foreign Application Priority Data

Oct. 5, 1989 [JP] Japan ..... 1-261593

[51] Int. Cl.[5] ..... B30B 1/32

[52] U.S. Cl. ..... 425/406; 100/269 R; 425/408

[58] Field of Search ..... 425/450.1, 451.2, 451.9, 425/78, 149, 152, 344, 352, 453, 457; 100/269 R, 295, DIG. 915

[56] References Cited

U.S. PATENT DOCUMENTS 3,677,685 7/1972 Aoki ..... 425/451.2
3,924,986 12/1975 Suler ..... 425/119
4,130,384 12/1978 MacMillan ..... 425/451.2
4,269,259 5/1981 Ueno et al. ..... 425/450.1
4,380,427 4/1983 Hehl ..... 425/451.2
4,588,539 5/1986 Rossi et al. ..... 425/451.2
4,861,259 8/1989 Takada ..... 425/451.2

*Primary Examiner*—Jay H. Woo
*Assistant Examiner*—Matney, Jr. William J.
*Attorney, Agent, or Firm*—Harrison & Egbert

[57] ABSTRACT

An apparatus for vertically moving a ram in a compression molding machine having a ram slidably fitted within an outer cylinder. The ram has a hollow portion which includes an oil reservoir. A piston is slidably fitted within this hollow portion. A source of air pressure is connected to a space between the piston and the top of the hollow portion. As air pressure is applied, the piston will move so as to displace oil from the hollow portion. A pilot check valve is positioned in the ram so as to pass oil into an area between the ram and the outer cylinder.

1 Claim, 3 Drawing Sheets

PRIOR ART

MEANS FOR VERTICALLY MOVING A RAM IN A COMPRESSION MOLDING MACHINE

BACKGROUND OF THE INVENTION

The present invention relates to a means for vertically moving a ram in a compression molding machine for rubber, plastic, etc.

Conventional means for vertically moving a ram in a compression molding machine include double-cylinder constructions comprising an outer cylinder and a ram slidably fitted therein, said ram having a hollow part in the center thereof and serving also as an inner cylinder. The double-cylinder constructions have been employed in large compression molding machines having a ram of a large diameter because the double-cylinder constructions have the advantage that they make it possible to use a hydraulic pump having a smaller capacity. FIG. 3 shows a typical conventional double-cylinder construction in a compression molding machine, which construction comprises an outer cylinder 1 and a ram or an inner cylinder 3 slidably fitted therein, said ram 3 being provided at the lower end thereof with a large-diameter portion 2, said ram 3 having a hollow part 4 in the center thereof, a rod 6 being fitted in said hollow part 4 so as to penetrate the bottom 5 of said outer cylinder 1, said rod 6 being slidable ralative to said ram 3 and immovably fixed to the bottom of said outer cylinder 1, said rod 6 being provided in the center thereof with an oil passage 7 penetrating the rod 6 from end to end. A space formed by the lower surface of said large-diameter portion 2 of the ram 3, the inner surface of said outer cylinder 1 and the periphery of said rod 6 serves as a lower oil reservoir 8. A portion of said hollow part 4 of the ram 3 over the rod 6 serves as a ram raising oil reservoir 9. A space formed by the periphery of the ram 3 and the inner surface of the cylinder 1 serves as a ram lowering oil reservoir 10. Numeral 11 represents a check valve, and numeral 12 represents an oil tank.

In the double-cylinder construction described above, the ram 3 will be raised when an oil pressure is applied to the ram raising oil reservoir 9 through the oil passage 7 within the rod 6. The ram 3 will be lowered if an oil pressure is applied to the ram lowering oil reservoir 10 when the ram 3 is in a raised position.

In the conventional means for vertically moving a ram in a compression molding machine, the ram is vertically moved by means of oil pressure only, and all oil used for vertically moving the ram is supplied from outside. Therefore, it is not necessarily possible to make external hydraulic apparatuses including the oil tank satisfactorily small and less expensive.

BRIEF SUMMARY OF INVENTION

It is an object of the invention to provide a means for vertically moving a ram in a compression molding machine, which means can make external hydraulic apparatuses therefor satisfactorily small and less expensive.

This object has been attained by a means for vertically moving a ram in a compression molding machine, in which means air pressure is employed for vertically moving the ram and a certain amount of oil used in vertically moving the ram is contained within the outer cylinder and the ram. More particularly, said object has been attained by a means for vertically moving a ram in a compression molding machine comprising an outer cylinder, a ram being slidably fitted within said outer cylinder, said ram being provided at the lower end thereof with a large-diameter portion and in the center thereof with a hollow part, a piston being slidably fitted in said hollow part, a portion of said hollow part of the ram over said piston serving as a ram raising air reservoir, a portion of said hollow part of the ram under said piston serving as a self-contained oil reservoir, a space formed by the lower surface of said large-diameter portion of the ram and the inner surface of said outer cylinder serving as a lower oil reservoir, a space formed by the periphery of said ram and the inner surface of said outer cylinder serving as a ram lowering oil reservoir, said self-contained oil reservoir and lower oil reservoir containing a certain amount of oil in total, an air passage being provided which leads from said ram raising air reservoir to external air pressure apparatuses, an oil passage being provided which leads from said ram lowering oil reservoir to external hydraulic apparatuses. said self-contained oil reservoir being connected to said lower oil reservoir through a pilot check valve, said pilot check valve usually allowing oil to flow only in the direction from said self-contained oil reservoir toward said lower oil reservoir, said ram lowering oil reservoir being connected to said pilot check valve through a pilot pressure passage, said pilot check valve allowing oil to flow in the reverse direction from said lower oil reservoir toward said self-contained oil reservoir when the pilot check valve receives a pressure of said ram lowering oil reservoir through said pilot pressure passage.

The operation of the means for vertically moving a ram in a compression molding machine according to the present invention will now be described.

In the means for vertically moving a ram in a compression molding machine according to the present invention, the self-contained oil reservoir and the lower oil reservoir contain a certain amount of oil in total. When the ram is in the lowest position, if the external air pressure apparatuses apply an air pressure through the air passage to the ram raising air reservoir, the piston within the hollow part of the ram will be pushed down by the air pressure. As the piston moves down, oil in the self-contained oil reservoir under the piston in the hollow part of the ram will move through the pilot check valve to the lower oil reservoir and push up the ram. The ram is moved up in this way.

When the ram in a raised position is to be moved down, the air pressure in the ram raising air reservoir is released into the atmosphere and an oil pressure is applied by the external hydraulic apparatuses through the oil passage to the ram lowering oil reservoir. Then, the pressure in the ram lowering oil reservoir will exert a force in the direction of lowering the ram. By this pressure, the pilot check valve will be opened through the pilot pressure passage and oil in the lower oil reservoir will be moved back through the pilot check valve into the self-contained oil reservoir. Therefore, the ram is moved down and the piston within the ram is moved up.

Thus, oil contained within the means for vertically moving the ram moves back and forth between the self-contained oil reservoir and the lower oil reservoir when the ram moves up and down.

DETAILED DESCRIPTION

Figure 1:
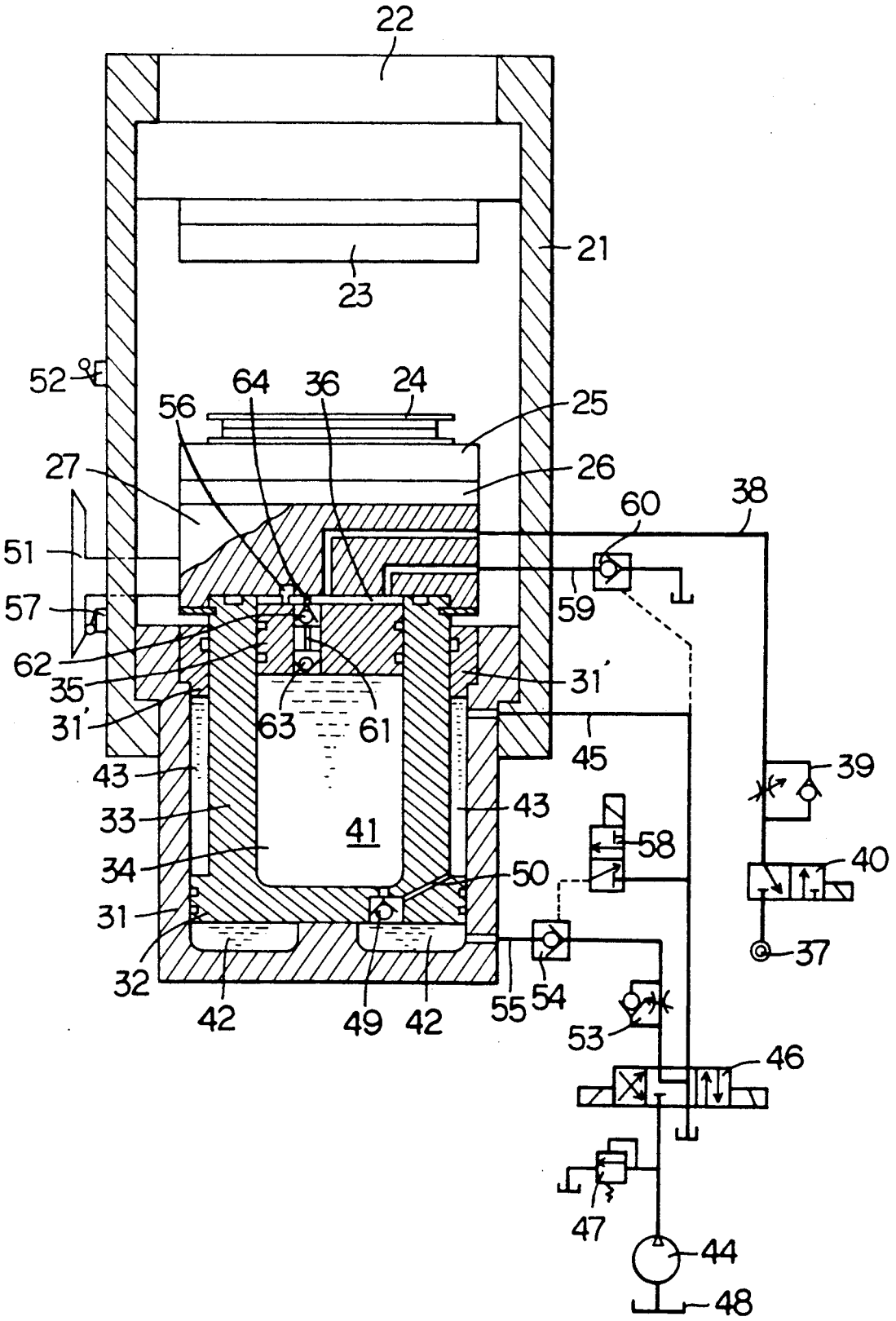
FIG. 1 is a vertical sectional view showing a means for vertically moving a ram according to the present invention in which the ram is in a lowered position.
Figure 2:
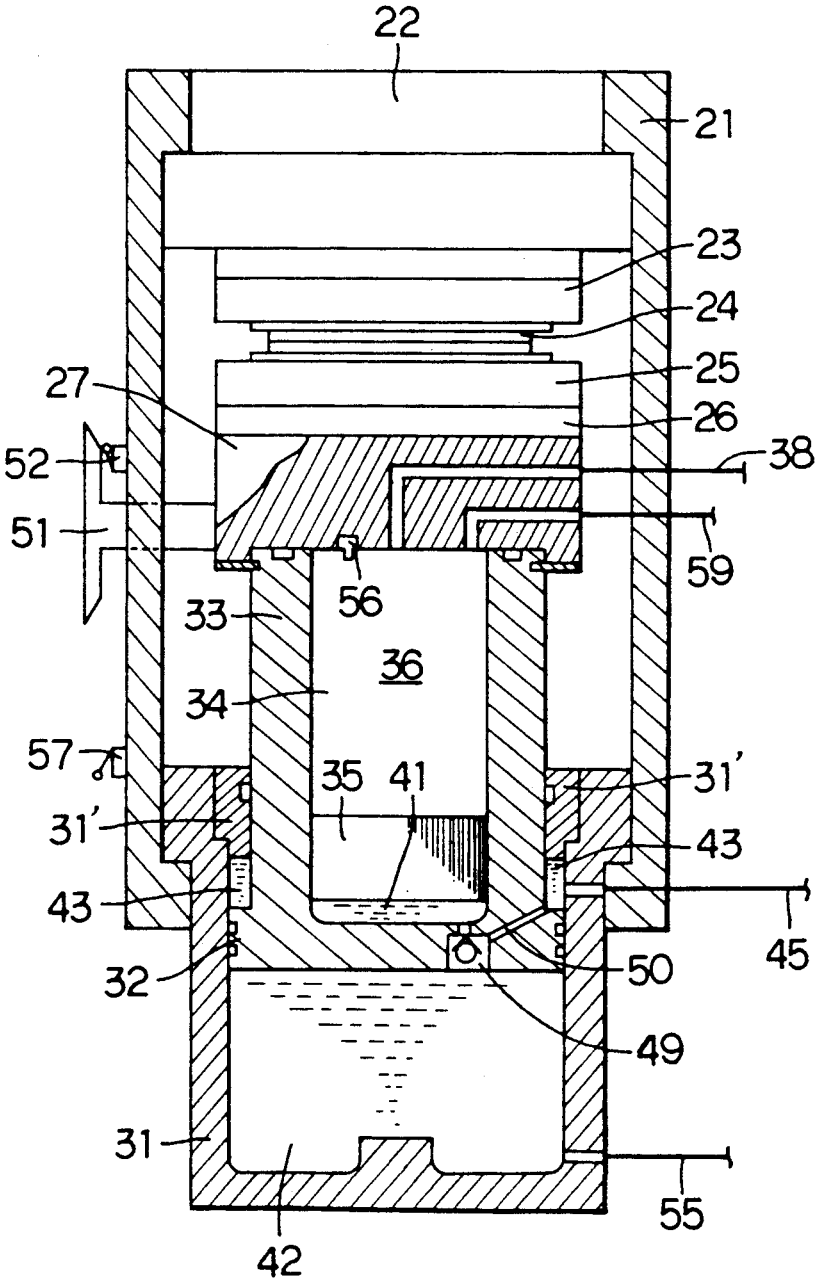
FIG. 2 is a vertical sectional view showing said means for vertically moving a ram in which said ram is in a raised position.
Figure 3:
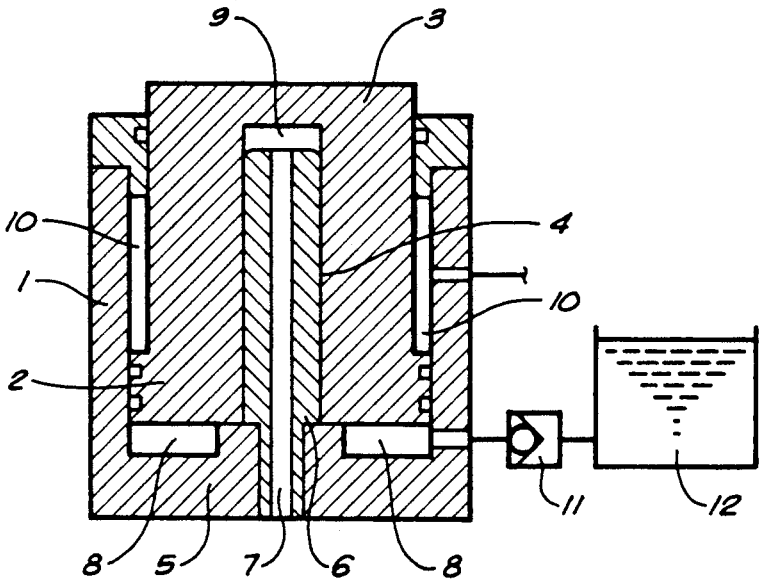
FIG. 3 is a vertical sectional view showing a conventional means for vertically moving a ram.

The present invention will now be described in detail with reference to the attached drawings.

A means for vertically moving a ram according to the present invention is used in a compression molding machine which, for example, has side plates 21, a head 22, an upper heating means 23, a mold 24, a lower heating means 25, a lower heat insulating means 26 and a movable plate 27.

An outer cylinder 31 is fixed to lower portions of the side plates 21. A ram 33, the top of which is fixed to the movable plate 27, is slidably fitted within the outer cylinder 31. The ram 33 is provided at the lower end thereof with a large-diameter portion 32 and in the center thereof with a hollow part 34. A piston 35 is slidably fitted in the hollow part 34. (Thus, the ram 33 serves also as an inner cylinder.)

A portion of said hollow part 34 of the ram 33 over the piston 35 serves as a ram raising air reservoir 36. An air passage 38 is provided which leads from the ram raising air reservoir 36 to an external air compressor 37. Numeral 39 represents an air flow control valve, and numeral 40 represents a direction control valve. A portion of said hollow part 34 of the ram 33 under the piston 35 serves as a self-contained oil reservoir 41. A space formed by the lower surface of said large-diameter portion 32 of the ram 33 and the inner surface of said outer cylinder 31 serves as a lower oil reservoir 42. An annular space formed by the periphery of the ram 33 and the inner surface of the outer cylinder 31 including the lower surface of a component member 31' of said outer cylinder 31 serves as a ram lowering oil reservoir 43. Said self-contained oil reservoir 41 and lower oil reservoir 42 contain a certain amount of oil in total. An oil passage 45 is provided which leads from the ram lowering oil reservoir 43 to an external hydraulic pump 44. Numeral 46 represents a direction control valve, numeral 47 represents a relief valve and numeral 48 represents an oil tank.

Said self-contained oil reservoir 41 within the ram 33 is connected to said lower oil reservoir 42 through a pilot check valve 49. Said pilot check valve 49 usually allows oil to flow only in the direction from the self-contained oil reservoir 41 toward the lower oil reservoir 42. Said ram lowering oil reservoir 43 is connected to the pilot check valve 49 through a pilot pressure passage 50. The pilot check valve 49 allows oil to flow in the reverse direction from the lower oil reservoir 42 toward the self-contained oil reservoir 41 when said pilot check valve 49 receives a pressure of the ram lowering oil reservoir 43 through the pilot pressure passage 50.

Now, a means for reducing the rising speed of the ram 33 before the mold 24 contacts the upper heating means 23 will be described. A projection 51 is attached to the movable plate 27, and a limit switch 52 corresponding to the projection 51 is disposed on one of the side plates 21. The projection 51 will contact and actuate the limit switch 52 immediately before the mold 24 in the upstroke contacts the upper heating means 23. Then, the direction control valve 40 will return to neutral and stop the supply of compressed air to the ram raising air reservoir 36. At the same time, the direction control valve 46 for the hydraulic system will allow oil to flow through an oil passage 55 by way of an oil flow control valve 53 and a pilot check valve 54 into the lower oil reservoir 42. At this time, if the oil flow into the lower oil reservoir 42 is smaller than a certain value, then the rising speed of the ram 33 will be reduced thereby.

Thus, oil is sent into the lower oil reservoir 42 from outside when the rising speed of the ram 33 is reduced. A means for returning such an increased amount of oil to outside will now be described. A sensor 56 is disposed at the upper end of said hollow part 34 of the ram 33. Said sensor 56 is adapted to detect the piston 35 when the piston 35 reaches the upper end of the hollow part 34. Another limit switch 57 is disposed on said one of the side plates 21, and this limit switch 57 is actuated by the projection 51 when the ram 33 has reached the lowest position. Numeral 58 represents a direction control valve for a pilot pressure for opening said pilot check valve 54. When the piston 35 reaches the upper end of the hollow part 34 of the ram 33 in the downstroke of the ram 33, the sensor 56 will detect it and actuate the direction control valve 58. Then, the direction control valve 58 will open the pilot check valve 54 by applying a pilot pressure to said valve 54. Now, oil in the lower oil reservoir 42 will return through the pilot check valve 54 into the oil tank 48. In this way, the oil sent into the lower oil reservoir 42 from outside when the rising speed of the ram 33 is reduced is returned to outside. Therefore, the total amount of contained oil remains constant and it is possible to lower the ram 33 again even after the piston 35 has reached the upper end of the hollow part 34.

Numeral 59 represents an oil discharging passage for discharging oil which has leaked into the ram raising air reservoir 36. The oil discharging passage 59 is provided with a pilot check valve 60. The pilot check valve 60 is opened by a pilot pressure obtained from a hydraulic pressure applied to the ram lowering oil reservoir 43 when the ram 33 is moved down. When the pilot check valve 60 is thus opened, oil which has leaked into the ram raising air reservoir 36 is discharged through the pilot check valve 60 to outside.

In an example shown in FIG. 1, the piston 35 is provided with an air extracting means for sending air, which has entered the self-contained oil reservoir 41 from the ram raising air reservoir 36, back to the ram raising air reservoir 36. In this example, a narrow air passage 61 vertically penetrating the piston 35 is provided with an upper air check valve 62 and a lower air check valve 63. The upper air check valve 62 is provided with a pin 64 protruding upward from the piston 35. The upper air check valve 62 is opened when the pin 64 is pushed down. The upper air check valve 62 prevents oil in the self-contained oil reservoir 41 from flowing out into the ram raising air reservoir 36, while the lower air check valve 63 prevents air in the ram raising air reservoir 36 from flowing into the self-contained oil reservoir 41. However, when the piston 35 has reached the highest position and the pin 64 is brought into contact with the upper surface of the ram raising air reservoir 36 and pushed down thereby, the upper air check valve 62 is opened, and air, which has entered the self-contained oil reservoir 41 from the ram raising air reservoir 36, is returned through the lower air check valve 63, the air passage 61 and the upper air check valve 62 into the ram raising air reservoir 36.

In the means for vertically moving a ram in a compression molding machine according to the present invention, air pressure is utilized for raising the ram and a certain amount of oil used in vertically moving the ram is contained in the self-contained oil reservoir and the lower oil reservoir, the contained oil moving back and forth between these two oil reservoirs when the ram is being moved up and down. This means that the amount of oil to be supplied from outside is very small. Therefore, it is possible to make the external hydraulic apparatuses very small and less expensive.

What is claimed is:

1. An apparatus for vertically moving a ram in a compression molding machine comprising:

an outer cylinder;

a ram being slidably fitted within said outer cylinder, said ram being provided at the lower end thereof with a large-diameter portion and in the center thereof with a hollow part;

a piston being slidably fitted in said hollow part, a portion of said hollow part of the ram over said piston serving as a ram raising air reservoir, a portion of said hollow part of the ram under said piston serving as a self-contained oil reservoir, a space formed by the lower surface of said large-diameter portion of the ram and the inner surface of said outer cylinder serving as a lower oil reservoir, a space formed by the periphery of said ram and the inner surface of said outer cylinder serving as a ram lowering oil reservoir, said self-contained oil reservoir and said lower oil reservoir containing a certain amount of oil in total;

an air passage being provided which leads from said ram raising air reservoir to an external air pressure apparatus;

an oil passage being provided which leads from said ram raising oil reservoir to an external hydraulic apparatus, said self-contained oil reservoir being connected to said lower oil reservoir through a pilot check valve in said ram, said pilot check valve allowing oil to flow only in the direction from said self-contained oil reservoir toward said lower oil reservoir, said ram lowering oil reservoir being connected to said pilot check valve through a pilot pressure passage, said pilot check valve allowing oil to flow in the reverse direction from said lower oil reservoir toward said self-contained oil reservoir when the pilot check valve receives a pressure of said ram lowering oil reservoir through said pilot pressure passage.

* * * * *